US005293690A

United States Patent [19]

Cassady

[11] Patent Number: 5,293,690

[45] Date of Patent: Mar. 15, 1994

[54] LOCKING DEVICE FOR FOLDING KNIFE, TOOL, ETC.

[76] Inventor: William E. Cassady, P.O. Box 723, San Anselmo, Calif. 94979

[21] Appl. No.: 834,463

[22] Filed: Feb. 12, 1992

[51] Int. Cl.[5] ..... B26B 1/04; B26B 1/02; B26B 1/00

[52] U.S. Cl. ..... 30/161; 30/160; 30/154

[58] Field of Search ..... 30/154, 155, 156, 158, 30/160, 161

[56] References Cited

U.S. PATENT DOCUMENTS

| | | | |
|---|---|---|---|
| 23,975 | 5/1859 | Belcher | 30/160 |
| 543,943 | 8/1895 | Minter | 30/160 |
| 553,430 | 1/1896 | Schmachtenberg | 30/158 |
| 749,230 | 1/1904 | Severance | 30/160 |
| 947,980 | 2/1910 | Romano | 30/153 |
| 1,478,260 | 12/1922 | Sibley | 30/157 |
| 4,133,106 | 1/1979 | Addis | 30/160 |
| 4,356,631 | 11/1982 | Guth | 30/154 |
| 4,535,539 | 8/1985 | Friedman et al. | 30/161 |
| 4,551,917 | 11/1985 | Walker | 30/161 |
| 4,612,706 | 9/1986 | Yunes | 30/160 |
| 4,974,323 | 2/1990 | Cassady | 30/155 |

*Primary Examiner*—Frank T. Yost
*Assistant Examiner*—Paul M. Heyrana, Sr.

[57] ABSTRACT

In a folding knife or hand tool having a handle and a blade pivotally connected to the handle, a spring loaded crossbolt 1 is fitted to the blade tang. One end of crossbolt 1 protrudes through an arcuate slot in the handle, crossbolt slot 32. A locking collar 19 on crossbolt 1 engages locking counterbores A 34 and B 36 located on the blade side of the opposite ends of crossbolt slot 32. When finger pressure is applied to the end of crossbolt 1, locking collar 19 is forced to disengage locking counterbore A 34 and retreat to a relieved area on the blade, collar relief 52. This permits the blade to be extended by forward finger pressure on crossbolt 1. When the blade is fully extended, spring pressure forces locking collar 19 into the opposite locking counterbore B 36, thus locking the blade. Reversing the sequence will close and lock the blade.

8 Claims, 2 Drawing Sheets

Figure 5:
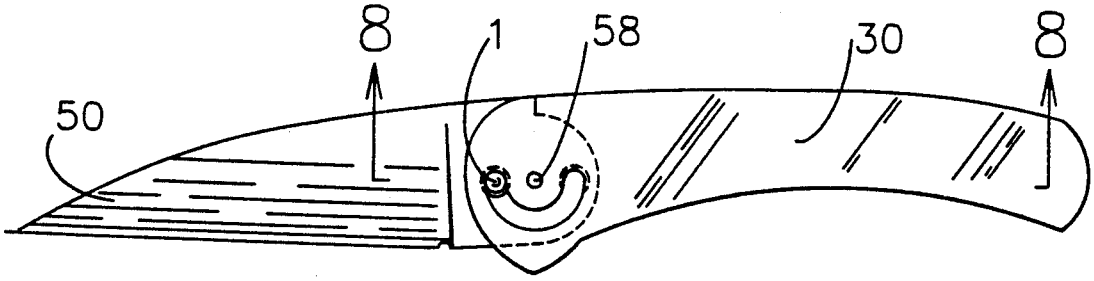

LOCKING DEVICE FOR FOLDING KNIFE, TOOL, ETC.

BACKGROUND

1. Field of Invention

This invention related to folding hand tools in which a blade or working member pivots into an enclosing protective sheath which forms a handle when the tool is in use, especially pocket knives, and specifically to an improved device for moving and locking the blade.

2. Discussion Of Prior Art

The folding knife provides numerous advantages of safety, compactness, and convenience of carry over the straight blade. However, these advantages come at the expense of several interrelated disadvantages:

(a) Difficulty of deployment. The insertion of a fingernail or a pinch grip on the blade spine, and subsequent manipulation of the blade into an open position is difficult at best. If the hands are cold, wet, or slippery, then blade extraction—especially against the pressure of a backspring—becomes infeasible.

(b) Two hands are required to open the blade. If one hand is unavailable, the remaining hand cannot open and deploy the blade unassisted.

(c) Strength of blade attachment. Blades are commonly attached to handles by a single pivot, which, in conjunction with whatever handle portion serves to limit their extent of opening, bears the entire working stress of the blade. Moreover, backspring and backlocking mechanisms generally preclude the use of through pins or rivets int he area of the blade pivot, which could otherwise maximize the strength of the pivot area—since this is precisely the area a spring or lever needs to move in.

(d) Blade security. Many persons feel that even the heaviest backspring pressure feasible to still allow a blade to open is insufficient to insure against accidental collapse of the blade. Many different types of blade locking devices, and knives in which the blade is positively locked against accidental closure, have been devised. Most designs gain locking security at the expense of convenience or strength.

(e) Blade wobble. Related to the previous factor. Manufacturing allowances must be provided so that parts can move freely. But in a folding knife this may result in mechanical looseness which is perceived as blade wobble. manufacturers commonly reduce perceived wobble in backspring knives by increasing backspring pressure. This makes such knives hard to open.

Some efforts to minimize or overcome these disadvantages are of particular interest:

Belcher, U.S. Pat. No. 23,975 (1859)
Minter, U.S. Pat. No. 543,943 (1895)
Schmachtenberg, U.S. Pat. No. 553,430 (1896)
Papendall, U.S. pat. No. 689,513 (1900)
Romano, U.S. Pat. No. 947,980 (1910)
Sibley, U.S. Pat. No. 1,478,260 (1922)
Grille, German U.S. Pat. No. 1,104,386 (1961)
Yunes, U.S. Pat. No. 4,612,706 (1986)

My own U.S. pat. No. 4,974,323 (1990) disclosed a folding knife or tool in which the blade is moved and locked by an integral control piece, which appears as a stem or button on the handle and a flat portion of which si moved within a cavity in the handle to position a crankpin on the blade tang. This design resolved for the first time the above mentioned problems. It provides total blade movement and locking control with a single button on the handle. However, despite the success of this design, some persons lack the manual dexterity to operate the knife easily. This difficulty is believed to relate to the eccentric movement of the control member, which requires that the finger change direction just at the point of least mechanical advantage.

An additional difficulty for these users is that the locking and unlocking operations require a separate and distance control movement from that used to move the blade.

Many users, therefore, would find it desirable to have a knife or folding tool which embodies a simplified means for achieving safe and effective one hand control of blade movement and locking, and which provides a constant leverage on the blade over the total path of the control member movement, and automatic locking of the blade at the open and closed positions.

OBJECTS AND ADVANTAGES

Accordingly, I claim the following as the objects and advantages of my invention:

to provide a folding knife or simplified construction in which it is unnecessary to touch the blade in order to open it, and in which external projections or concavities on the blade, which are designed to be caught by the finger or fingernail are avoided;

to provide such a knife in which all blade control functions are provided by an extensible control member fitted to the blade tang and carried by the tang within an arcuate slot in the handle;

to provide a folding knife which may be easily and conveniently unlatched from a closed and locked condition while held in the hand, by the manipulation of a control member by a finger;

to provide such a knife, the blade of which may be easily and conveniently moved and latched into an open and locked condition by the manipulation of an extensible control member by a finger;

to provide that the manual dexterity required to operate such knife be at a minimum;

to provide an improved movement path, with a control device having a constant leverage ratio during the operating cycle of such knife;

to provide that the blade of such knife be safely and automatically locked in the open and closed positions of blade travel.

Reader will find further objects and advantages of the invention from a consideration of the ensuing description and the accompanying drawings.

DRAWING FIGURES

Figure 1:
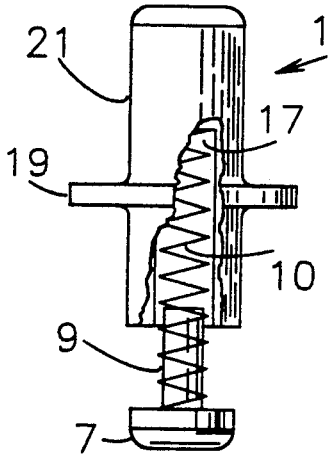

FIG. 1 Side cutaway view of crossbolt 1.

Figure 2:
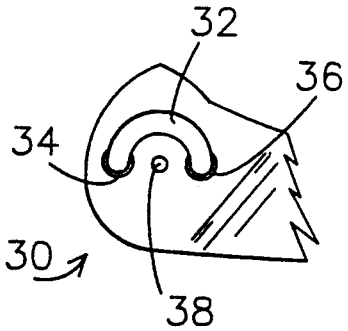

FIG. 2 Bottom view of front handle plate 30, showing crossbolt slot 32; locking counterbore A 34; and locking counterbore B 36.

Figure 3:
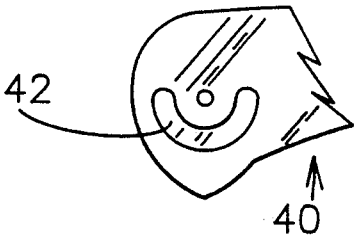

FIG. 3 Top view of back handle plate 40, showing follower relief slot 42.

Figure 4:
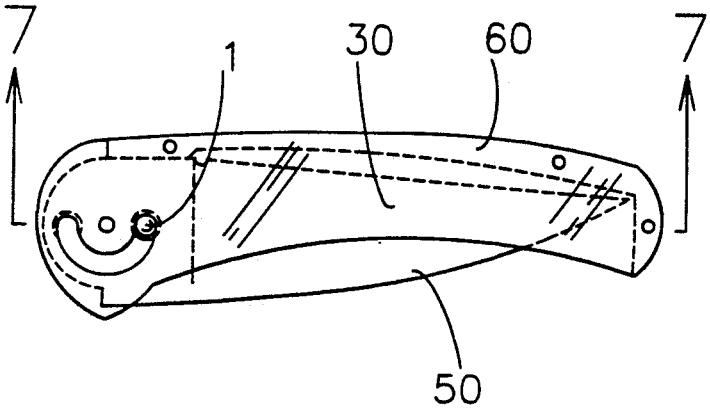

FIG. 4 Top view of assembled knife, showing front handle plate 30; crossbolt 1; blade 50 in closed position; hidden line profile of spine 60; and showing cutting plane 7.

FIG. 5 Top view of knife, showing crossbolt 1 in blade 50, in open position; and showing cutting plane 8.

Figure 6:
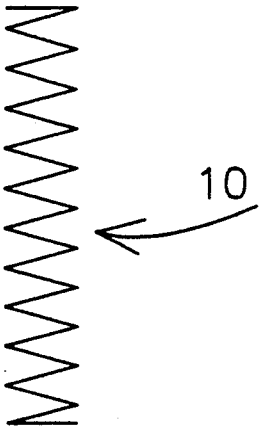
Figure 6:
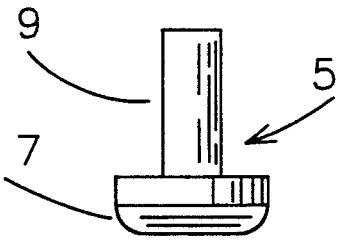

FIG. 6 Side view of crossbolt 1 components: crossbolt follower 5 and its features; toe 7, and shaft 9; crossbolt spring 10; crossbolt body 15 and its features, follower bore 17, crossbolt collar 19, and crossbolt head 21.

Figure 7:
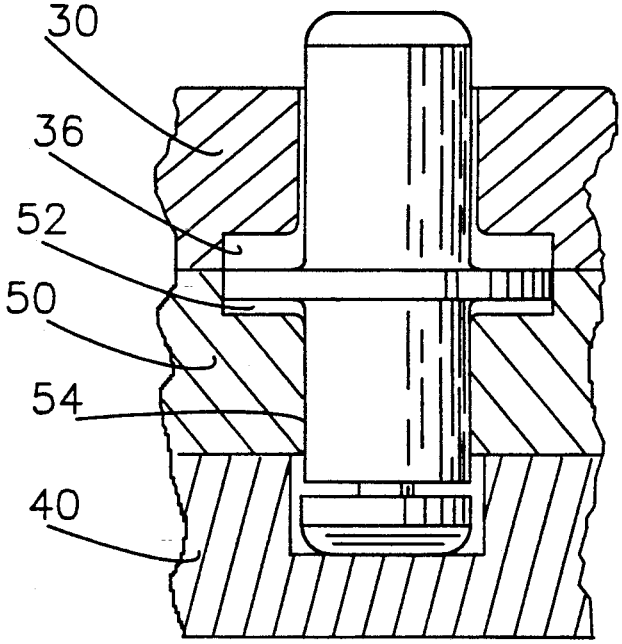

FIG. 7 Section view through knife body at cutting plane 7, showing back handle plate 40; blade 50; front handle plate 30 with its locking counter bore B 36. Crossbolt 1 is shown unsectioned in the unlocked position with crossbolt collar 19 pushed into collar relief 52 in blade 50.

Figure 8:
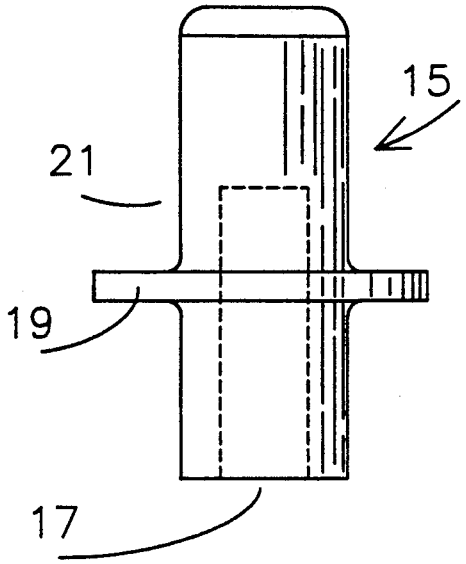
Figure 8:
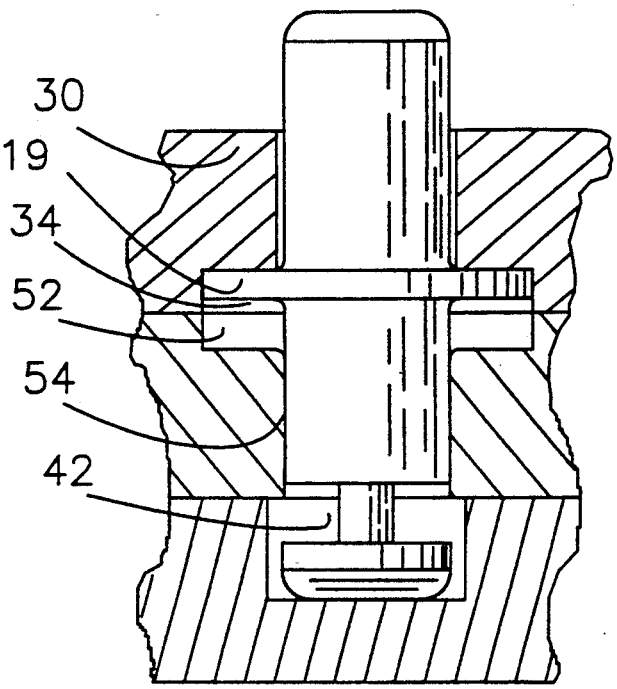

FIG. 8 Section view through knife body at cutting plane 8 showing crossbolt 1, unsectioned, in locked position. Crossbolt collar 19 is shown within locking counterbore A 34 in front handle plate 30.

LIST OF REFERENCE NUMERALS

1: crossbolt
5: crossbolt follower
7: toe, of crossbolt follower 5
9: shaft, of crossbolt follower 5
10: crossbolt spring
15: crossbolt body
17: follower bore in crossbolt body 15
19: crossbolt collar, on crossbolt body 15
21: crossbolt head, on crossbolt body 15
30: front handle plate
32: crossbolt slot, in front handle plate 30
34: locking counterbore A, in 30 (open position)
36: locking counterbore B, in 30 (closed position)
38: blade pivot bore, in front handle plate 30
40: back handle plate
42: follower relief slot, in back handle plate 40
50: blade
52: relief counterbore, in blade 50
54: crossbolt bore, in blade 50
58: pivot bore, in blade 50
60: spine

CROSSBOLT KNIFE -- DESCRIPTION

FIG. 1 shows a cutaway view of crossbolt 1. FIG. 6 shows the components and features of crossbolt 1; the crossbolt body 15, comprising the crossbolt head 21, the crossbolt collar 19, and the follower bore 17.

Crossbolt spring 10 is of such diameter as to enter follower bore 17; of such wire size as to accommodate the entrance of shaft 9 of crossbolt follower 5 as far as toe 7 of crossbolt follower 5. Crossbolt spring 10 is of sufficient length to maintain a constant pressure between crossbolt body 15 and crossbolt follower 5 at all times when assembled.

FIG. 4 shows the assembled knife, the handle of which comprises the front handle plate 30, and the back handle plate 40, separated and located by spine 60. Spine 60 is shaped to located the handle plates the proper distance apart and in alignment with each other by means of pins, rivets or other fasteners well known to the art.

In the forward part of front handle plate 30 is crossbolt slot 32, a through arcuate slot radially centered on blade pivot bore 38, FIG. 2. The radial thickness of the lot is such as to just accommodate crossbolt head 21, FIG. 6, FIG. 7, FIG. 8, which protrudes through ti from below, as will be fully explained later. At each end of crossbolt slot 32 is a counterbore, locking counterbore A 34, and B 36, of sufficient depth to allow the entrance of crossbolt collar 19 to its full thickness and of such diameter that said crossbolt collar 19 fits snugly. This is shown in the section view of FIG. 8.

In the tang of bald 50, at the radius of crossbolt slot 32 is crossbolt bore 54, of a size to provide a snug fit for crossbolt body 15. Collar relief 52 is concentric with crossbolt bore 54, and is deep enough to accommodate the thickness of crossbolt collar 19 in a downward position, as shown in FIG. 7.

On back handle plate 40, shown in FIG. 3, and matching the position described for crossbolt slot 32, is follower relief slot 42. This slot is deep enough to accommodate such length of crossbolt follower 5 and crossbolt body 15 as protrude below the thickness of blade 50. FIG. 7, FIG. 8.

Parts of such a knife are made of a strong rigid material, ordinarily steel or stainless steel, high strength low weight alloys such as titanium or aluminum, ceramic or plastic, but not limited to these materials.

FOLDING KNIFE -- OPERATION

In a closed and locked position, shown in FIG. 4, the full length of the cutting edge of blade 50 is enclosed between the handle plates, front handle plate 30 and back handle plate 40. The crossbolt 1, FIG. 1, FIG. 6, is held in a upward extended position by pressure of crossbolt spring 10 between crossbolt follower 5 and crossbolt body 15. Crossbolt collar 19 is seated within tang against locking counterbore B 36 as shown in FIG. 8. Thus blade 50 cannot rotate without shearing crossbolt 1 between blade 50 and front handle plate 30.

When it is desired to extend the blade, finger pressure is directed downward on crossbolt head 21 of crossbolt body 15. This causes crossbolt collar 19 to exit locking counter bore B 36 and to enter relief counterbore 52 in blade 50, as shown in FIG. 7.

Forward finger pressure on crossbolt body 15 will now push blade 50 into an open position. Crossbolt collar 19 is now clear of front handle plate 30 and is prevented from passing upward in response to the urging of crossbolt spring 10 by the greater diameter of crossbolt collar 19 than the width of crossbolt slot 32, which, it will be remembered, is just wide enough to admit crossbolt head 21.

When blade 50 reaches an extended position, it is topped either by the impingement of the blade tang against spring 60, as is usual in the art, or by the availability of locking a counterbore A 34 to receive crossbolt collar 19, which said instances are contrived to correspond closely. Then the pressure of crossbolt spring 10 will force crossbolt collar 19 into locking counterbore A 34 to securely lock blade 50 against retreat. This cycle simply reversed to close and lock the blade.

Thus, the reader will see that the folding knife of the present invention provides considerable advantages of strength, simplicity, mechanical integrity, convenience, safety and workability.

While my above description contains many specification, the reader should not construe these as limitation on the scope of the invention, but merely as exemplification of preferred embodiments thereof. Those skilled in the art will envision many other possible variations are within its scope. For example, endless variations on blade and handle shapes are possible with knives, to fit a particular or general use envisioned.

Among other hand tools, punches, picks, awls, scribers, files, hooks, combs, will come readily to mind. Also optical devices such as magnifiers; sampling devices such as spoons, cups, spatulas; sensing and measuring devices such as feeler gauges, pH meters, or thermometers, conductivity meters, etc.

Although working or structural parts of knives have traditionally been made of steel and heavy alloys, other materials such as ceramics, light alloys and plastics are coming into use. An ultralight and serviceable defense weapon of fiber-reinforced plastic could unquestionably be manufactured according to the invention.

Accordingly, the scope of the invention should be determined, not by the embodiments which have been illustrated here, but by the appended claims and their legal equivalents.

I claim:

1. A folding hand tool comprising:

an elongated handle;

a working element rotating on a pivot attached to one end of said handle, said handle supporting said working element in an extended position and enclosing said working element in an enfolded position;

said handle further comprising an arcuate slot with ends, substantially centered on said pivot, and adjacent to said working element;

said arcuate slot having enlarged cavity means adjacent to said ends of said arcuate slot;

said working element having elongated crossbolt means located in an aperture in said working element;

said crossbolt means formed of two parts; each having two ends, and comprising elastic means forcing said ends apart, one end of said crossbolt means comprising a head portion which protrudes through said arcuate slot in said handle, and a broad ended portion which engages and disengages said cavity means;

whereby the opening and closing of said working element and the establishment and removal of the crossbolt in the locked positions of said arcuate slot at said extended open position and said closed position may be achieved by directed finger pressure upon said crossbolt means.

2. The invention of claim 1, in which said broadened portion of said crossbolt means further comprises a collar.

3. The invention of claim 1, in which said elastic means of said crossbolt further comprises a spring.

4. The invention of claim 1, in which said elastic means is substantially enclosed within a cavity in said crossbolt means.

5. A folding hand tool comprising:

an elongated handle;

a working element rotating on a pivot which is attached to one end of said handle, said handle supporting said working element in an extended position and enclosing said working element in an enfolded position;

said handle further comprising an arcuate slot with ends substantially centered on said pivot and adjacent to said working element;

said arcuate slot having enlarged cavity means located adjacent to said working element and substantially at the ends of said arcuate slot on said handle;

said working element comprising elongated crossbolt means located in an aperture in said working element, and axially engaging and disengaging said cavity means in said handle;

said crossbolt means having two ends, and resilient means which influence one end of said crossbolt means to engage with said cavity means;

said end of said crossbolt means further comprising a head portion which protrudes through said arcuate slot in said handle and a broadened portion which engages and disengages said cavity means;

whereby the opening or closing of said working element and the establishment and removal of the crossbolt in the locked positions of sia arcuate slot at said extended open working position and said closed position may be achieved by direct finger pressure upon said crossbolt means.

6. The invention of claim 5, in which said broadened portion of said crossbolt means further comprises a collar.

7. The invention of claim 5, in which said resilient end further comprises a spring.

8. The invention of claim 5, in which said resilient means are substantially enclosed by said crossbolt means.

* * * * *